US008640620B1

(12) United States Patent
Hoang et al.

(10) Patent No.: US 8,640,620 B1
(45) Date of Patent: Feb. 4, 2014

(54) NON-INERTIAL SAFE AND ARM DEVICE

(75) Inventors: Thinh Q. Hoang, Beltsville, MD (US); Charles H. Robinson, Wyckoff, NJ (US); Robert H. Wood, Laurel, MD (US); Ryan R. Knight, Bethesda, MD (US); Oliver M. Barham, Washington, DC (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/411,918

(22) Filed: Mar. 5, 2012

(51) Int. Cl.
*F42C 15/184* (2006.01)

(52) U.S. Cl.
USPC ..... 102/256; 102/229

(58) Field of Classification Search
USPC ..... 102/222, 223, 229, 254, 256
See application file for complete search history.

(56) References Cited

U.S. PATENT DOCUMENTS

| | | | | |
|---|---|---|---|---|
| 5,131,328 | A * | 7/1992 | Chan | 102/229 |
| 6,167,809 | B1 * | 1/2001 | Robinson et al. | 102/235 |
| 6,568,329 | B1 * | 5/2003 | Robinson | 102/231 |
| 7,142,087 | B2 * | 11/2006 | Greywall | 337/36 |
| 8,276,515 | B1 * | 10/2012 | Robinson et al. | 102/231 |
| 8,448,574 | B1 * | 5/2013 | Robinson et al. | 102/235 |

* cited by examiner

*Primary Examiner* — James Bergin
(74) *Attorney, Agent, or Firm* — Michael C. Sachs

(57) ABSTRACT

A safety and arming device may include a substrate and a frame fixed to the substrate. The frame may include a travel slot, a head socket, first and second gas expansion chambers having respective first and second nozzles, and first and second safety catch surfaces disposed adjacent to the respective first and second nozzles. A slider may be translatably disposed in the travel slot in the frame. The slider may include a latching head operable to latch in the head socket in an armed position of the device, a storage cavity for storing an explosive charge, first and second cantilevered arms disposed axially apart from each other and angled outwardly from the slider, and first and second deactivation cavities disposed adjacent to the respective first and second cantilevered arms. A spring may bias the slider away from the head socket.

17 Claims, 8 Drawing Sheets

NON-INERTIAL SAFE AND ARM DEVICE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to fuzes and safety and arming (S&A) devices and in particular to non-inertial, non-spin S&A devices.

To assure safety in the transportation, handling, and deployment of military hardware with explosive components, munition-fuze safety standards such as MIL-STD-1316 or STANAG 4187 require that two unique and independent aspects of the launch or deployment environment be detected in the weapon fuze system before the weapon can be enabled to arm. Examples of aspects of the projectile launch environment that are sensed electronically or mechanically in existing munition system S&A devices include, but are not limited to, setback acceleration, rifling- or fin-induced spin, and gun- or launch-tube exit or airflow/drag due to high velocity travel.

S&A devices for conventional military munitions may use setback (i.e. gun-launch) acceleration and projectile spin as inertial inputs or environments to effect arming. However, some tube- or gun-launched munitions may not utilize bore rifling to spin the projectile. And, other munitions, such as hand grenades or mines, may not be launched from a gun or tube platform and, therefore, may lack spin and setback accelerations entirely.

Some prior S&A devices are disclosed in U.S. Pat. No. 7,316,186, "Air-Powered Electro-Mechanical Fuze for Submunition Grenades," issued 8 Jan. 2008 to Robinson et al.; U.S. Pat. No. 6,964,231, "Miniature MEMS-Based Electro-Mechanical Safety and Arming Device," issued 15 Nov. 2005 to Robinson et al.; U.S. Pat. No. 6,308,631 to Smith et al.; U.S. Pat. No. 6,173,650 to Garvick et al.; U.S. Pat. No. 6,167,809 issued on Jan. 2, 2001 to Robinson et al., entitled "Ultra-Miniature Monolithic, Mechanical Safety-and-Arming Device for Projected Munitions"; U.S. Pat. No. 5,824,910 to Last et al.; U.S. Pat. No. 5,693,906 issued on Dec. 2, 1997 to Van Sloun and entitled "Electro-Mechanical Safety and Arming Device"; U.S. Pat. No. 5,275,107 issued on Jan. 4, 1994 to Weber et al. and entitled "Gun-Launched Non-Spinning Safety and Arming Mechanism;" and pending U.S. patent application Ser. No. 12/434,093 filed on May 1, 2009 entitled "Ultra-Miniature Electro-Mechanical Safety and Arming Device" and having the same assignee as this application. All the above-listed patents and patent applications are expressly incorporated by reference herein.

All of the devices in the aforementioned patent literature use at least one of the following environments to achieve electro-mechanical safety and arming: setback acceleration during gun- or tube-launch, rifling or fin-induced spin, and gun- or tube-launch exit and airflow/drag due to high velocity projectile travel.

A long-felt and unsolved need exists for an apparatus and method for the safety and arming of explosive hardware without the use of or necessity for setback acceleration, projectile spin, or airflow drag. Such an apparatus and method may enable wide application of explosive components, for example, across different weapons systems or platforms, and may increase the safety of munitions which could not previously take advantage of advanced safety features.

SUMMARY OF THE INVENTION

It is an object of the invention to provide an apparatus and method for the safety and arming of explosive hardware without the use of or necessity for setback acceleration, projectile spin, or airflow drag.

One aspect of the invention is a safety and arming device that may include a substrate and a frame fixed to the substrate. The frame may include a travel slot, a head socket, first and second gas expansion chambers having respective first and second nozzles, and first and second safety catch surfaces disposed adjacent to the respective first and second nozzles. A slider may be translatably disposed in the travel slot in the frame.

The slider may include a latching head operable to latch in the head socket in an armed position of the device, a storage cavity for storing an explosive charge, first and second cantilevered arms disposed axially apart from each other and angled outwardly from the slider, and first and second deactivation cavities disposed adjacent to the respective first and second cantilevered arms.

A spring may bias the slider away from the head socket. In a first safe position of the device, an end of the first cantilevered arm may contact the first safety catch surface to thereby prevent translation of the slider toward the head socket and an end of the second cantilevered arm may be spaced apart from the second safety catch surface.

The frame may include a second head socket. One end of the spring may be fixed to the slider and another end of the spring may be fixed to a second latching head. The second latching head may be disposed in the second head socket. The latching head and the second latching head may include flexible barbs for locking the latching heads in respective head sockets.

The substrate may include a receptor charge hole. The receptor charge hole may be aligned with the storage cavity in the slider in an armed position of the device and not aligned with the storage cavity in the slider in the first safe position of the device. In a second safe position of the device, the first cantilevered arm may be plastically deformed into the first deactivation cavity and the end of the second cantilevered arm may contact the second safety catch surface. In the second safe position of the device, the receptor charge hole may not be aligned with the storage cavity in the slider.

In the armed position of the device, the first cantilevered arm may be plastically deformed into the first deactivation cavity and the second cantilevered arm may be plastically deformed into the second deactivation cavity.

Another aspect of the invention is a method that may include providing a safety and arming device and delivering gas to a first gas expansion chamber. The gas may be used to deform a first cantilevered arm into a first deactivation cavity. The method may include exerting a force, other than an inertial force, on a slider to translate the slider toward a head socket. An end of a second cantilevered arm may contact a safety catch surface to stop translation of the slider toward the head socket.

The method may include delivering a second gas to a second gas expansion chamber. The second gas may be used to deform the second cantilevered arm into a second deactivation cavity. Then, the latching head of the slider may be translated into the head socket.

Another aspect of the invention is a safety and arming assembly that may include a safety and arming device and a cover assembly disposed adjacent to the safety and arming device. The cover assembly may include an input explosive column and a pair of through holes for gas. One through hole may communicate with a first gas expansion chamber and another through hole may communicate with a second gas expansion chamber.

In an armed position of the safety and arming device, the input explosive column may be aligned with a storage cavity in a slider and with a receptor charge hole in a substrate.

A dielectric layer may be disposed adjacent to the cover assembly. The dielectric layer may include a first spot charge aligned with the input explosive column of the cover assembly, a second spot charge aligned with the one of the through holes in the cover assembly, and a third spot charge aligned with the other of the though holes in the cover assembly.

An initiator board assembly may be disposed adjacent to the dielectric layer. The initiator board assembly may include electrically initiated circuits for initiating the first, second, and third spot charges in the dielectric layer.

An output explosive assembly may be disposed adjacent to a substrate of the safety and arming device. The output explosive assembly may include an output explosive column aligned with the receptor charge hole in the substrate.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
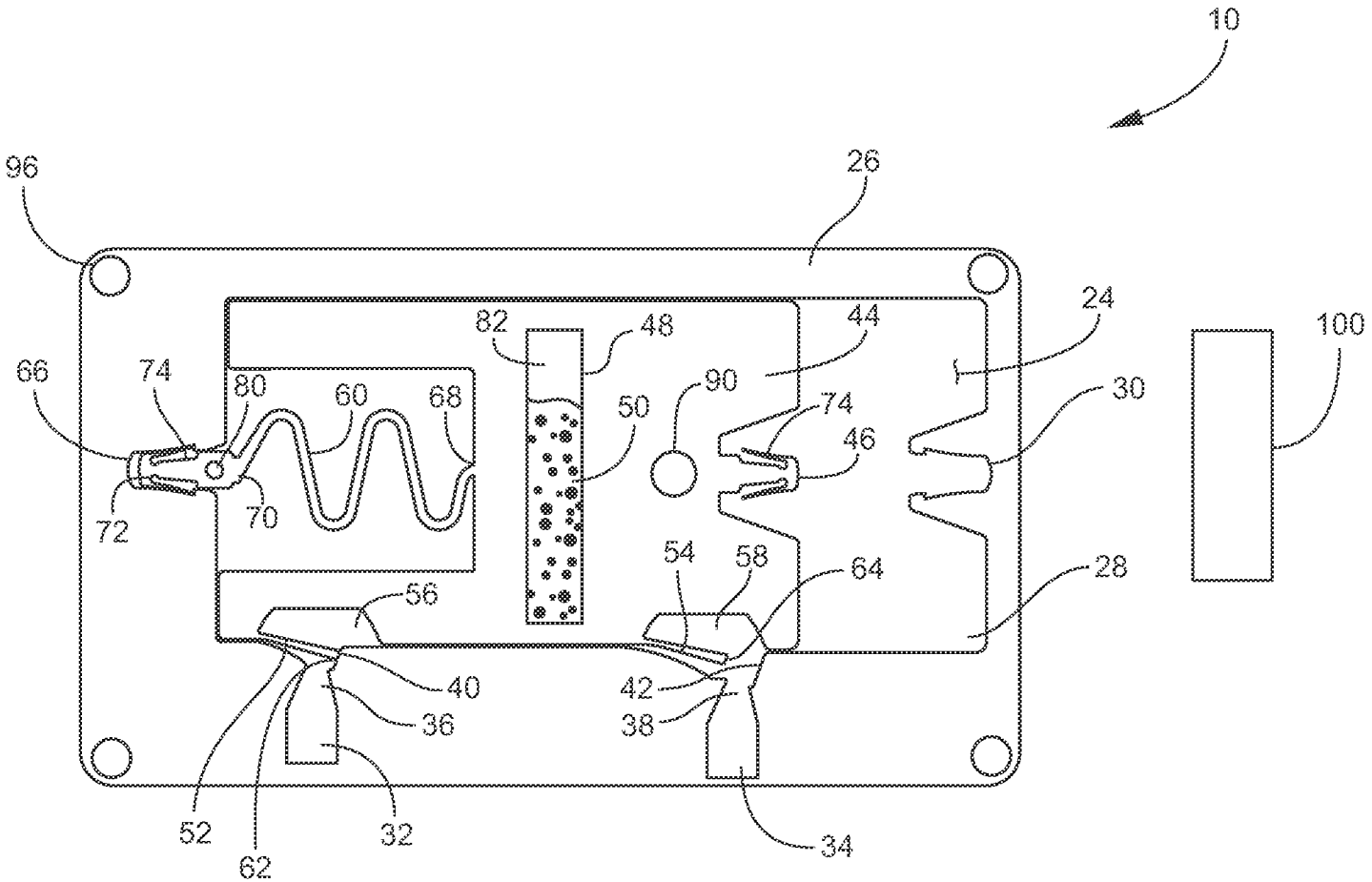
FIG. 1 is a plan view of one embodiment of a MEMS S&A device, showing a latching and arming slider in its initial position (a first safe position), with a first safety-lock enabled and a second safety-lock disabled.

A MEMS S&A device may be used for electro-mechanical fuzes and S&A assemblies. The device may be used in non-inertial or low-inertial environments. The device may be used with non-spin or low-spin rate munitions. For military applications, the device may be used for munitions that are not gun-launched. The device may enable safety and arming in apparatus that cannot use set-back acceleration and/or spin to differentiate between a safe state and an armed state.

The device may include interrelated mechanical and electronic safety logic for reliability and safety. The device may incorporate and manipulate a key moveable component in a microscale firetrain. The microscale firetrain, when activated, may begin with an initiating spot charge and end with a detonating output at the output end of the S&A assembly.

The S&A device may be fabricated using micro-electro-mechanical systems (MEMS) based technology and processes. The S&A device may be fabricated or assembled using similar-scale technologies such as micro-molding, electro-plating, polishing and releasing, metal and ceramic nano-powder molding, micro-casting or sintering, etc. A principal application of the S&A device may be in the field of military weaponry. The weaponry may include, for example, devices such as hand-grenades, detonators, micro-flight robot and cyborg insect payloads, and unmanned vehicle munitions. The device may be used in civilian commercial and aerospace systems, as well.

The device may, at a minimum, satisfy the requirements of munition safety standards and best practices. The device may satisfy the above safety requirements through the exploitation of sequential electromechanical inputs. The S&A device may provide a safe, reliable, miniaturized, efficient means of executing electro-mechanical safety and arming logic for the operational life cycle of, for example, military munitions, hardware that contains explosives, and hardware that contains energetic material. The device may execute safety and arming functions without traditional environmental inputs, such as setback acceleration, rifling or fin-induced spin, gun or launch-tube exit, and airflow/drag due to high velocity projectile travel. By using MEMS miniaturization to reduce its size, the S&A device may increase the effectiveness of munition fuzes in which it is used. For example, the smaller size and weight of the S&A device may enable more weapon payload, or the addition of other devices, such as integrated electronics, etc. Devices such as integrated electronics may improve munition sensing and/or performance on target.

The S&A device may enable safety and arming in applications that previously could not take advantage of a S&A device, thereby greatly increasing the safety of the end user, for example, military personnel. The device may also use mechanical logic that may be simpler than known electro-mechanical safety and arming devices. These simplifications may have the benefit of reducing the parts count or the number of operations necessary to manufacture and produce the S&A device, thereby reducing the cost of manufacturing. Fewer parts and fewer manufacturing operations may improve the reliability of the S&A device. Additionally, reducing the overall size of the S&A assembly may enable munition fuze designers to place MIL-STD-1316-compliant S&A devices in smaller and lighter applications, and/or to advantageously utilize the fuze volume saved by the smaller S&A device, for other purposes.

The S&A device may enable the use of electronic-logic-based fuzes in some applications, whereas, in the past, only mechanical stab initiated fuzes could be used. The incorporation of electronic logic in such systems enables more accurate timing and, subsequently, greater safety compared to, for example, pyrotechnic powder column delay fuzes. Electronic logic may also enable the integration of sensors such as impact switches, anti-tamper switches, acoustic sensors, and radio frequency or other electro-magnetic or remote-command signals. Electronic logic may enable the use of self-destruct or self-neutralization functions and improved reliability.

The design of the S&A device may incorporate safety as a paramount goal. For example, the S&A device may contain no stored energy that is capable of mechanically arming the S&A. The inventive MEMS S&A device may fulfill the safety requirements for fuzing in MIL-STD-1316, Safety Criteria for Fuze Designs. It may also meet the safety requirements stated in NATO Standardization Agreement (STANAG) 4187, Fuzing Systems-Safety Design Requirements.

The safety of the S&A device of a fuze may derive from the selective mechanical and electro-mechanical logic intrinsic to the design. Predetermined external inputs may be used as triggers for the device's arming actions. External inputs that do not match the proper sequence of the predetermined external inputs may result in one of two outcomes: a) the mechanical logic elements may partially respond to the inputs and then reset to their original "safe" (unarmed) position, or b) the mechanical logic elements may partially respond to the inputs and, due to the out-of-sequence or improper nature of the inputs, the mechanical elements may finish in a "failed safe" condition.

Figure 2:
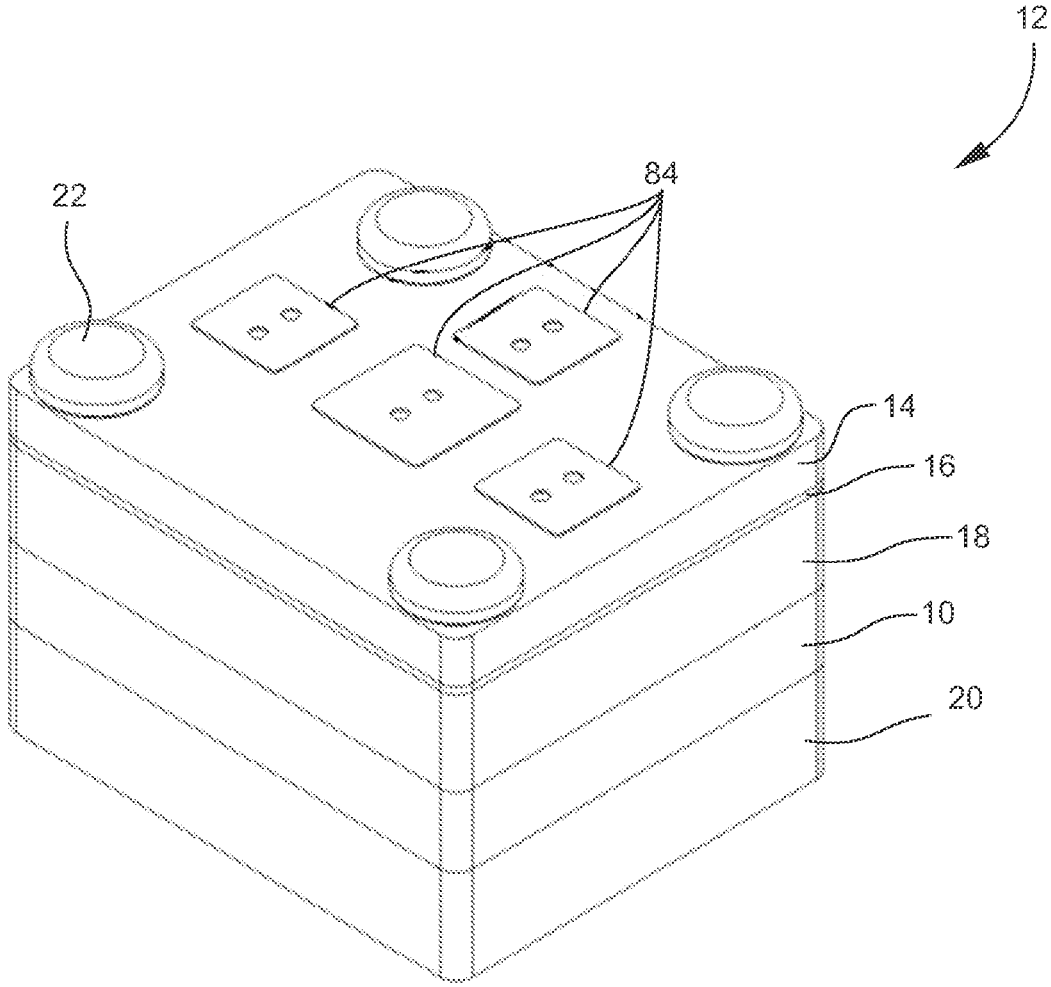
FIG. 2 is an isometric view of one embodiment of an S&A assembly that incorporates the MEMS S&A device of FIG. 1.
Figure 3:
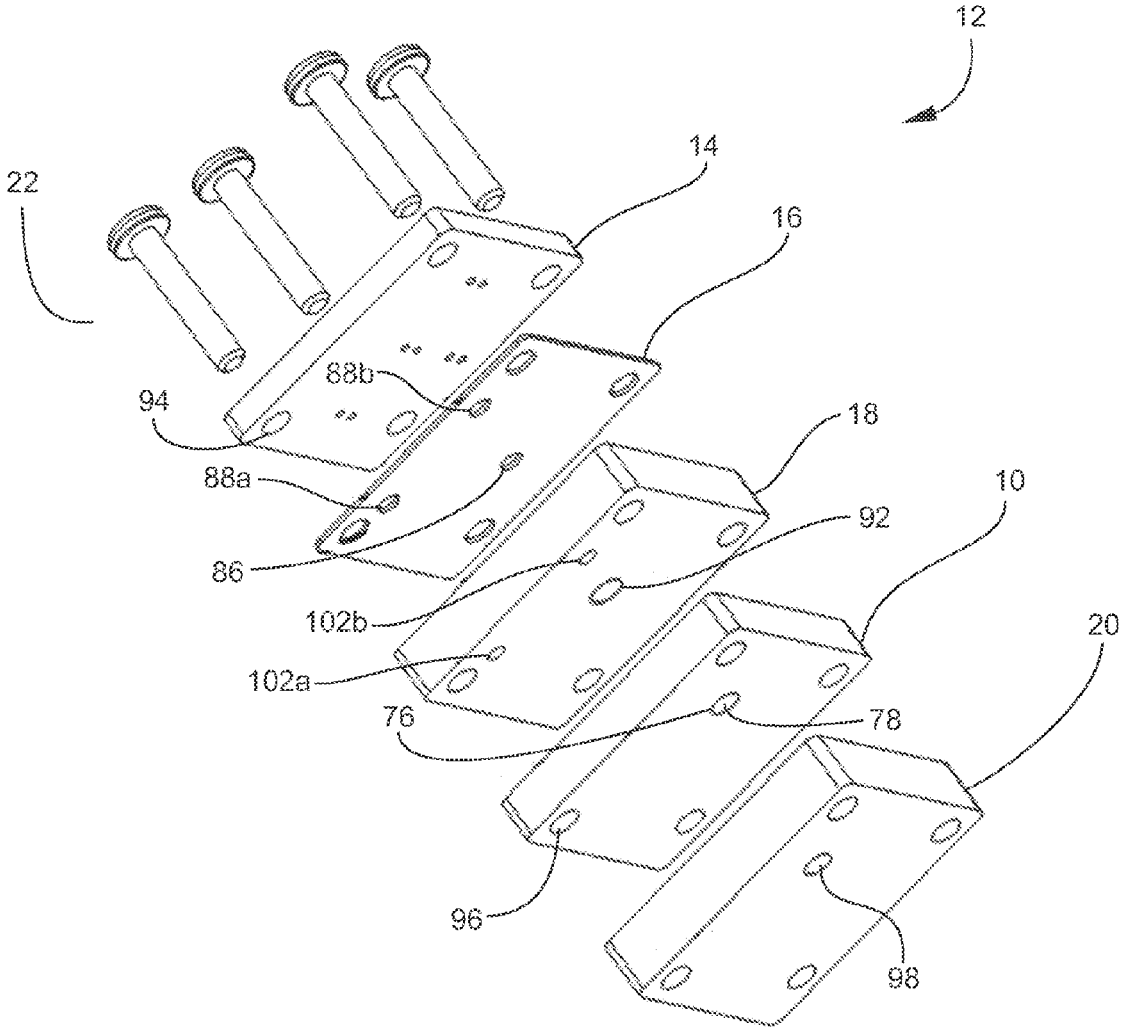
FIG. 3 is an isometric exploded view of the S&A assembly of FIG. 2.
Figure 4:
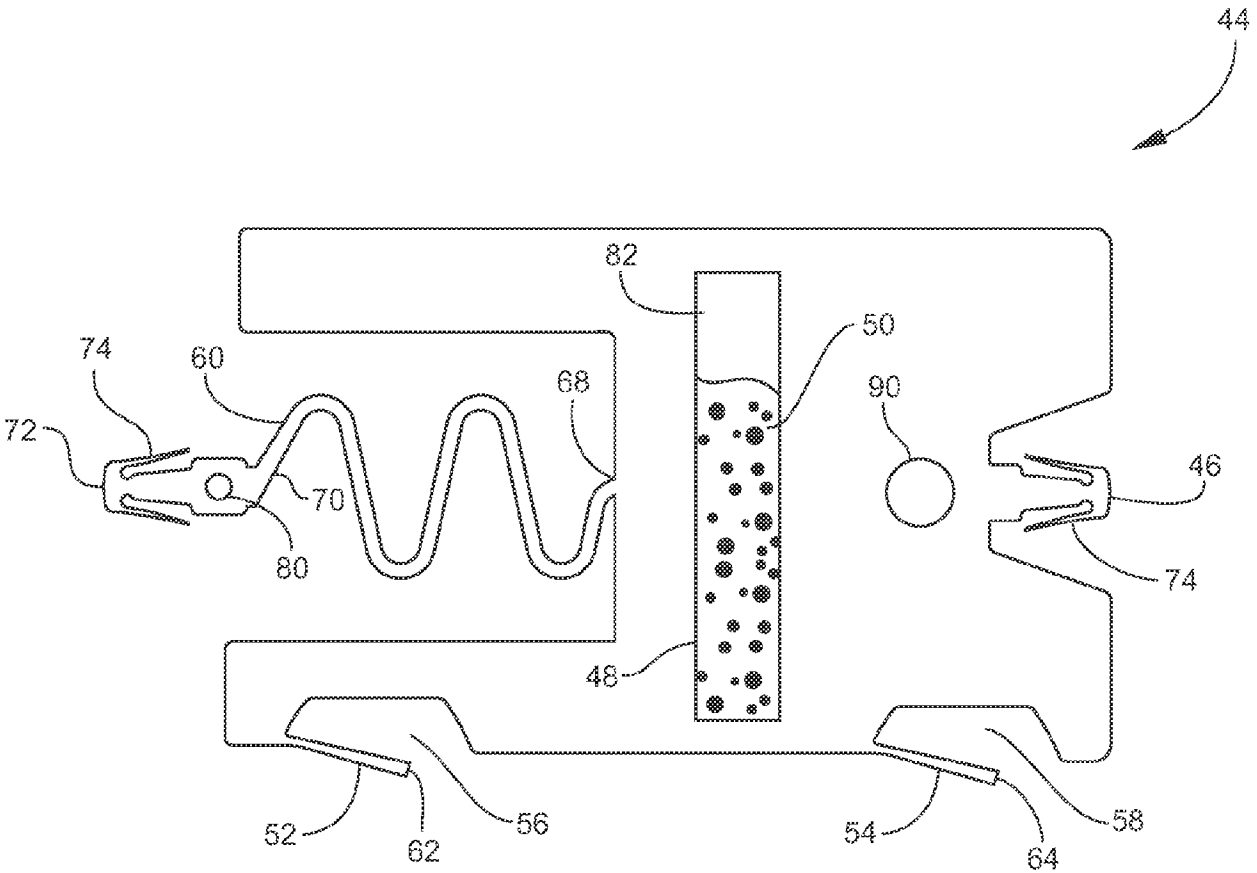
FIG. 4 is a plan view of the latching and arming slider of FIG. 1.

FIG. 1 is a plan view of one embodiment of a MEMS S&A device 10. Device 10 may be used in an S&A assembly 12, shown in FIGS. 2 and 3. S&A assembly 12 may include an initiator board assembly 14, a dielectric layer 16, a cover assembly 18, a MEMS S&A device 10, and an output explosive assembly 20. The components of assembly 12 may be held together by, for example, screws, rivets, welded pins, body welds, encasements, or other fastening or confining means. FIGS. 2 and 3 show pins 22 that are used to mechanically fix the components of assembly 12 together. Alignment holes 94 near the corners of initiator board assembly 14 may be aligned with holes 96 (see also FIG. 1) in the S&A device 10 and with other holes in dielectric layer 16, cover assembly 18 and output explosive assembly 20.

Initiator board assembly 14 may include an initiator/fuze interface component that ignites the initiating explosives. Initiator board assembly 14 may include contact pads 84 that may enable assembly 14 to be surface-mounted directly on a fuze circuit board, if desired. Cover assembly 18 may contain explosives and may enable explosive build-up. MEMS S&A device 10 may respond to input stimuli and effectuate and manage the position of a key movable firetrain element in relation to input and output explosive trains. Output explosive assembly 20 may augment and direct the explosive output. An operational novelty in device 10 and assembly 12 is the ability to arm S&A device 10 without the use of traditional arming environments. Thus, device 10 and assembly 12 may be used in entirely new S&A applications, such as a hand grenade fuze having a fully out-of-line firetrain, thereby increasing safety for the end user.

As shown in FIG. 1, MEMS S&A device 10 may include a substrate 24 and a frame 26 fixed to substrate 24. Frame 26 may include a travel slot 28, a head socket 30, and first and second gas expansion chambers 32, 34. Gas expansion chambers 32, 34 may include respective nozzles 36, 38. First and second safety catch surfaces 40, 42 may be disposed adjacent to respective nozzles 36, 38. A latching and arming slider 44 may be translatably disposed in travel slot 28 in frame 26. Travel slot 28 may guide and constrain the in-plane motion of slider 44 as slider 44 translates from a safe to an armed position. Frame 26 and slider 44 may be made of, for example, metal. Metal may provide strength, ductility and explosive confinement.

Figure 6:
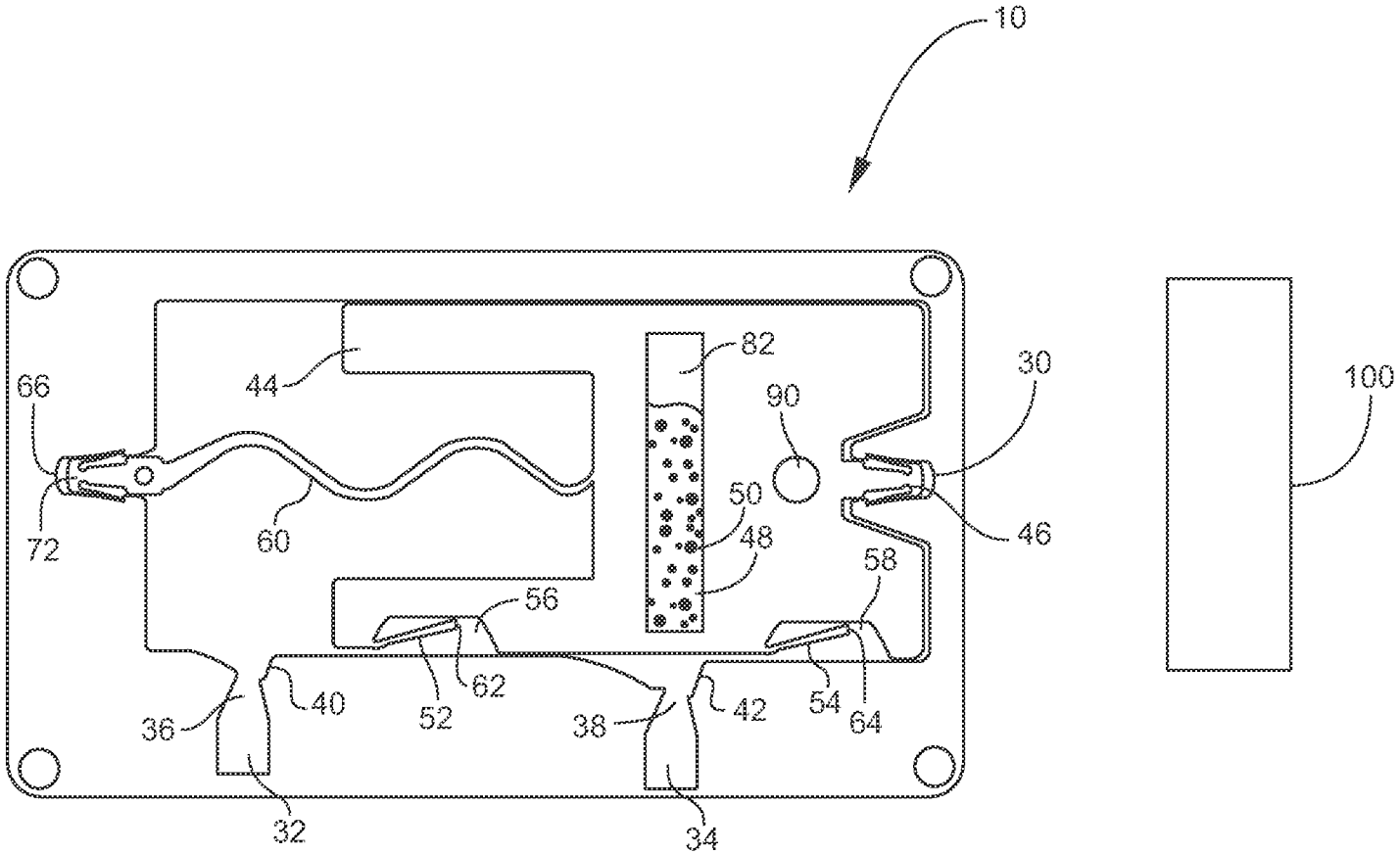
FIG. 6 is a plan view of the MEMS S&A device of FIG. 1, showing the latching and arming slider in the armed position

Slider 44 may include a latching head 46 operable to latch in head socket 30 in an armed position of device 10 (FIG. 6). Slider 44 may include a storage cavity 48 for storing an explosive transfer charge 50. A membrane 82 may seal the bottom of storage cavity 48. Slider 44 may include a manipulator probe hole 90.

Slider 44 may include first and second cantilevered arms 52, 54 disposed axially apart from each other. "Disposed axially apart" means spaced apart along the translation axis of slider 44. As viewed in FIG. 1, the translation axis of slider 44 is horizontal. Arms 52, 54 may be angled outwardly from slider 44 so that arms 52, 54 may engage respective safety catch surfaces 40, 42. In some embodiments, more than two cantilevered arms may be included. First and second deactivation cavities 56, 58 may be disposed in slider 44 adjacent to respective first and second cantilevered arms 52, 54. Device 10 may include a spring 60 that biases slider 44 away from head socket 30. In a safe position of device 10 (FIG. 1), an end 62 of first cantilevered arm 52 may contact first safety catch surface 40 to thereby prevent translation of slider 44 toward head socket 30. In the safe position of FIG. 1, an end 64 of second cantilevered atm 54 may be spaced apart from second safety catch surface 42.

Frame 26 may include a second head socket 66. One end 68 of spring 60 may be fixed to slider 44 and another end 70 of spring 60 may be fixed to a second latching head 72. Second latching head 72 may be disposed in second head socket 66. During assembly of S&A device 10, latching head 72 may be extended into head socket 66 while in plane with travel slot 28 to ensure a spring tension that biases slider 44 away from the aimed position. As viewed in FIG. 1, spring tension of spring 60 biases slider 44 horizontally to the left.

Latching heads 46, 72 may include flexible barbs 74 for locking latching heads 46, 72 in respective head sockets 30, 66. Barbs 74 may elastically or plastically deform to allow latching heads 46, 72 to enter sockets 30, 66, and then spring back sufficiently to lock heads 46, 72 inside respective sockets 30, 66. Latching head 72 may include a probe hole 80 to assist in placing latching head 72 in head socket 66.

Substrate 24 may include a receptor charge hole 76 (FIG. 3) containing a receptor charge 78. Receptor charge hole 76 may be aligned with storage cavity 48 in slider 44 in an armed position (FIG. 6) of device 10. In a safe position (FIG. 1) of device 10, receptor charge hole 76 may not be aligned with storage cavity 48 in slider 44. Receptor charge hole 76 may be a blind hole that opens on a side of substrate 24 opposite frame 26. A membrane (not shown) may be disposed in one end of receptor charge hole 76 between substrate 24 and frame 26. The membrane may prevent particles of receptor charge 78 from entering travel slot 28. Receptor charge 78 may be detonated by the explosive output of transfer charge 50 in storage cavity 48 when slider 44 is in the armed position.

Referring to FIGS. 2 and 3, initiator board assembly 14 may be a laminated circuit board or a flex circuit. Initiator board assembly 14 may electrically connect to a fuze circuit (not shown) via contact pads 84 (FIG. 2). The bottom surface of initiator board assembly 14 may include a lamination having integral electrically conductive traces. The electrically conductive traces may incorporate thin film bridges (for initiation of explosive spot charges). Electrical connection may be made through the thickness of the initiator board assembly 14 from the fuze circuit interface (contact pads 84) on top to the conductive traces located in the bottom surface.

Dielectric layer 16 may include openings therein to give access to, and provide explosive loading volume for, two or more initiator bridges. Primary explosive spot charges may be loaded on top of the thin film or other type bridges at these locations. A firetrain initiator bridge and spot charge 86 may be thermally or electrically stimulated to thereby initiate the train of microscale explosive components inside the MEMS S&A assembly 12. The train of explosive components may build up to a detonating output to initiate an external firetrain, such as that of a military weapon, or cause another desired outcome.

"Command" initiator bridges and spot charges 88*a* and 88*b* in dielectric layer 16 may be thermally or electrically stimulated to thereby generate gases that flow through respective command holes 102*a* and 102*b* in cover assembly 18. Gases generated from spot charges 88*a* and 88*b* may pressurize gas expansion chambers 32 and 34 in frame 26 (FIG. 1) to thereby actuate or disable first cantilevered arm 52 or second cantilevered arm 54 (depending on the location of slider 44). Firetrain initiator bridge and spot charge 86 may align with, fire into and initiate an input explosive column 92 in cover assembly 18. Input explosive column 92 may be loaded in a through-hole in cover assembly 18.

Cover assembly 18 may protect and mechanically constrain slider 44 to operate in-plane in MEMS device 10. Cover assembly 18 may assist the transfer of, or amplify the explosive or energetic output from, initiator bridges and spot charges 88*a*, 88*b* in dielectric layer 16. Ignition of explosive column 92 in cover assembly 18 may build to a detonation prior to output at the bottom side of cover assembly 18, as explained in U.S. Pat. No. 7,055,437 entitled "Micro-Scale Firetrain for Ultra-Miniature Electro-Mechanical Safety and Arming Device" issued to Robinson et al. on Jun. 6, 2006, and in U.S. Pat. No. 7,069,861 entitled "Micro-Scale Firetrain for Ultra-Miniature Electro-Mechanical Safety and Arming Device" issued to Robinson et al. on Jul. 4, 2006. The contents of U.S. Pat. Nos. 7,055,437 and 7,069,861 are expressly incorporated by reference herein.

Output explosive assembly 20 may include an output charge cavity into which an output explosive charge 98 may be placed. Output charge 98 may be configured to fire explosively or energetically straight through the plane of the base of output explosive assembly 20, or to fire laterally out any of the edges or in any direction needed. Output charge 98 may be protected by a membrane of material that is part of the base of output explosive assembly 20. Receptor charge 78 in substrate 24 may fire into and detonate output charge 98.

When slider 44 is in the armed position (FIG. 6), transfer charge 50 in slider 44 may be aligned with input explosive column 92 in cover assembly 18 and may also be aligned with receptor charge 78 in substrate 24. Input column 92 may include a combination or stack of primary (sensitive) and secondary explosives. Transfer charge 50, receptor charge 78 and output explosive charge 98 may be composed of secondary explosives. When slider 44 is in a first safe position (FIG. 1), transfer charge 50 may not be aligned with input explosive column 92 nor with receptor charge 78. Transfer charge 50 may be held some lateral distance away from both input explosive column 92 and receptor charge 78 for safety reasons. Thus, in the safe position of FIG. 1, an unintended initiation of input column 92 would not be able to "transfer" through frame 26 or substrate 24 and into receptor charge 78. The safe position of FIG. 1 renders the assembly 12 incapable of unintended explosive transfer, as is explained in U.S. Pat. No. 7,055,437.

As manufactured, the movable components of MEMS S&A device 10 may be disposed as shown in FIG. 1 with slider 44 inserted into, or, alternately, fabricated in-situ inside frame 26. Slider 44 may be positioned at the left end of travel slot 28 with spring 60 pre-tensioned by insertion of spring latching head 72 into head socket 60, where head 72 latches. Cantilevered arms 52, 54 may extend downward away from slider 44.

From the point of manufacture to the point of use, S&A assembly 12 may experience diverse dynamic and inertial inputs. These inputs may result from, for example, manufacturing-imposed loads in the factory, manual handling, inspection, packaging, freight loading and transportation, storage, and logistical deployment. These inputs may include impacts, accelerations, and a spectrum of vibration inputs. The S&A assembly 12 is designed to "reject" all such inputs and combinations of events, up to but not including the inputs desired for operation, by retaining slider 44 in the safe position of FIG. 1. The S&A assembly 12 may reject vibration inputs, so far as arming is concerned, because slider 44 may be locked in place by first cantilevered arm 52 resting on corresponding safety catch surface 40, and also because of tensioned spring 60 that is locked in place with latching head 72.

The S&A assembly 12 may also reject logistical acceleration inputs such as impacts, so far as arming is concerned, again because of first cantilevered arm 52 and safety catch surface 40 (the first safety-lock), and also because of tensioned spring 60. In the event of deflection of cantilevered arm 52 due to, for example, unintended initiation of spot charge 88*a*, slider 44 may be slightly displaced. But, spring 60 may restore slider 44 to the safe position. Even after a lateral applied acceleration toward arming (rightward), slider 44 may also remain in the safe position, due to the factors mentioned above. Additionally, slider 44 may be prevented from arming in the event that cantilevered arm 52 is bent or unintentionally deformed upward into deactivation cavity 56 and spring 60 failed, because end 64 of second cantilevered arm 54 would contact safety catch surface 42.

During the course of intended operation, S&A assembly 12 may encounter environmental conditions or designated inputs that may trigger arming. For example, an unmanned aerial vehicle (UAV) may be loaded with a munition while on the ground and arming of the munition may be desired when the UAV reaches a certain altitude. Or, a hand-grenade equipped with S&A assembly 12 may require a soldier to pull a pin and release a handle to trigger an arming sequence.

In FIG. 1, S&A device 10 is in the first safe position with the first safety lock enabled, that is, end 62 of cantilevered arm 52 is in contact with safety catch surface 40. Initiation of first command initiator bridge and spot charge 88*a* releases gas through opening 102*a* in cover assembly 18 and pressurizes gas expansion chamber 32. Gas in chamber 32 is forced through nozzle 36 and impinges energetically on cantilevered arm 52. Cantilevered arm 52 may be permanently deformed upward into deactivation cavity 56 (see FIG. 5), where it rests during the remainder of its operational life. The removal of cantilevered arm 52 permits slider 44 to translate, provided that a body force (for example, a magnetic force) is acting on slider 44 to move it into the second safe position shown in FIG. 5. Forces other than a magnetic force may be used. In the case of a magnetic force, the force may be supplied by a permanent magnet 100 and slider 44 may be made of a magnetically permeable material.

In the second safe position, end 64 of arm 54 contacts safety catch surface 42 and creates a seal for gas expansion chamber 34. From the second safe position of FIG. 5, if the body force was removed, spring 60 would draw slider 44 back to its initial safe position shown in FIG. 1. From the initial safe position of FIG. 1 and irrespective of the condition of first cantilevered arm 52, a premature initiation of second spot charge 88*b* would force gas at high pressure into gas expansion chamber 34 and through its corresponding nozzle 38.

Figure 7:
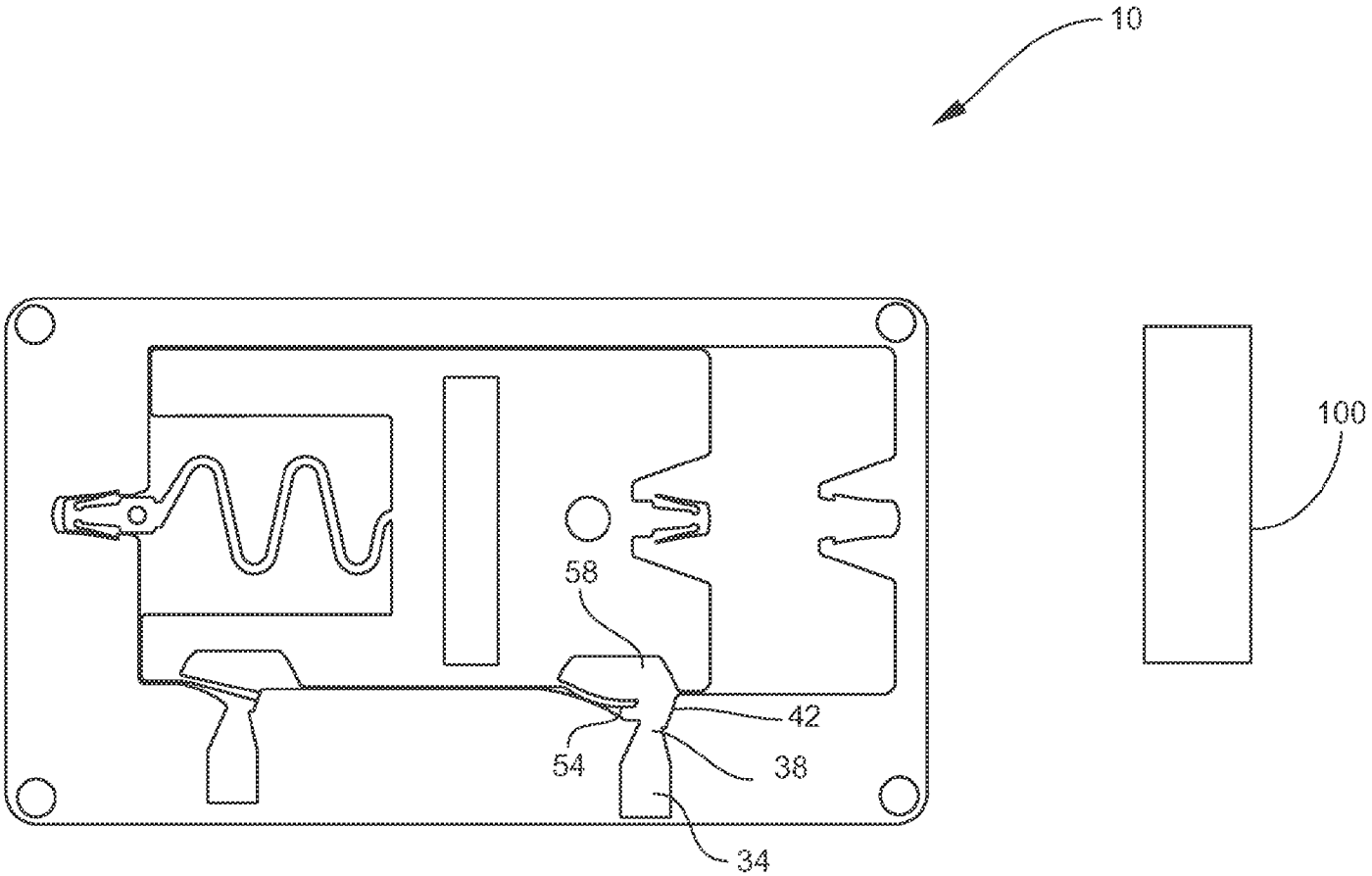
FIG. 7 is a plan view of the of the MEMS S&A device of FIG. 1, showing permanent mechanical deformation to the latching and arming slider caused by the second command charge (explosive spot charge) firing before the latching and arming slider reaches the second safe position (i.e. before the second safety-lock is enabled)

The gas from nozzle 38 would act on the upper face (the face adjacent to deactivation cavity 58) of second cantilevered arm 54 and permanently deform arm 54 downward into frame 26, as shown in FIG. 7.

In the state shown in FIG. 7, with second arm 54 deformed downward, if a body force were again applied to slider 44 to attempt to advance it towards arming, permanently deformed arm 54 would engage with safety catch surface 42 and permanently prevent movement of slider 44 to the armed position shown in FIG. 6. This sequence of events would correspond to a "failed-safe" condition of the S&A device 10.

Figure 5:
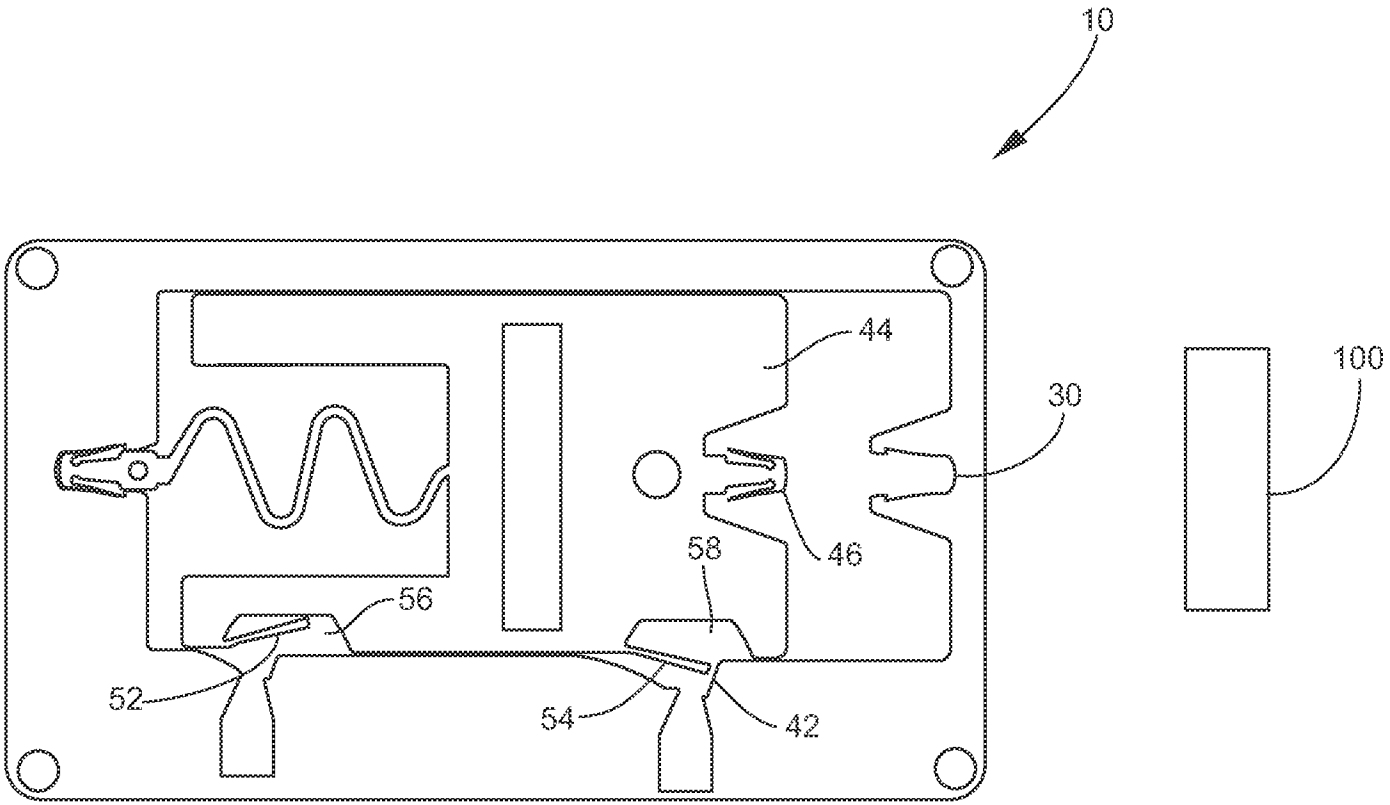
FIG. 5 is a plan view of the MEMS S&A device of FIG. 1, showing the latching and arming slider in a second safe position with the second safety-lock enabled.

Referring again to the transition from the first safe position of FIG. 1 to the second safe position of FIG. 5, although first cantilevered arm 52 may be deformed upward by initiation of spot charge 88*a*, slider 44 may not advance further toward arming without a body force being exerted on slider 44. The body force may be a magnetic force supplied by, for example, permanent magnet 100. The magnetic force of magnet 100 may tend to pull slider 44 towards head socket 30, thereby stretching spring 60 and enabling the second safety lock. The second safety lock is enabled when end 64 of cantilevered arm 54 contacts safety catch surface 42. When the body force acting on slider 44 is a magnetic force, slider 44 may be made of a magnetically permeable material. Magnet 100 may be mounted adjacent S&A device 10 and S&A assembly 12. Of course, other forces may be used to translate slider 44 for arming, such as pneumatic, electrical or mechanical forces applied by micro-machine motors, and engagements powered by thermal or piezoelectric or other type drives, sometimes referred to as scratch and gear drives. However, the force used to translate slider 44 for arming is not an inertial force such as, for example, spin, set-back acceleration, set-forward acceleration, etc.

Only in the presence of a body force or other applied driving force may cantilevered arm 54 move into position so that end 64 contacts safety catch surface 42 and creates a seal (FIG. 5). Creation of the seal enables the second safety lock (cantilevered arm 54) to then be removed. Upon initiation of spot charge 88*b*, gas produced by charge 88*b* flows through opening 102*b* in cover assembly 18 and into gas expansion chamber 34. The pressurized gas in chamber 34 deforms second cantilevered arm 64 upwards into deactivation cavity 58. Then, in the presence of the body or driving force (for example, from magnet 100) latching head 46 of slider 44 will move towards head socket 30. When head 46 is latched in socket 30 as shown in FIG. 6, the firetrain is then aligned for a complete arming sequence. A complete arming sequence may occur when transfer charge 50 is aligned with input explosive column 92 in cover assembly 18, receptor charge 78 in substrate 24, and output charge 98 in output explosive assembly 20.

In some embodiments, the engagements of ends 62, 64 of arms 52, 54 with respective safety catch surfaces 40, 42 may occur simultaneously and at the same axial translation of slider 44. In these embodiments, the actuations of cantilevered arms 52, 54 by respective spot charges 88*a*, 88*b* may occur simultaneously. Such an arrangement may be preferred where the demands of safety are not as extreme, for example, in a civilian market application.

However, fuze safety may be enhanced by the requirement that the arming inputs occur in a certain sequence or order, specifically: initiation of first command spot charge 88*a*; then, rightward acceleration of slider 44 due to an external force; then, while in the presence of the external force, initiation of the second spot charge 88*b*, followed by continuing application of the external force to fully latch slider 44 using latching head 46 in socket 30. The external force, such as a magnetic force, may be applied at a certain time by, for example, the generation of a field, a pressure, or movement of a magnet.

If an unforeseen event causes both command charges 88*a*, 88*b* to initiate simultaneously, the first cantilevered arm 52 may permanently deform into deactivation cavity 56 and the second cantilevered arm 54 may deform downward against frame 26 (as shown in FIG. 7), causing S&A device 10 to be permanently prevented from arming. In the unlikely event that both cantilevered arms 52, 54 were missing or unintentionally deformed upward into respective deactivation cavities 56, 58, slider 44 could still not move into its fully armed position without the imposition of an external force to work against spring 60, thereby providing a final safety measure against unintentional arming. The external force, such as a magnetic force, may be selectively applied to S&A device 10 at various functional stages of device 10, depending on the design of the overall apparatus of which device 10 is a part. Thus, the external force may not necessarily always or constantly be applied to device 10.

Figure 8:
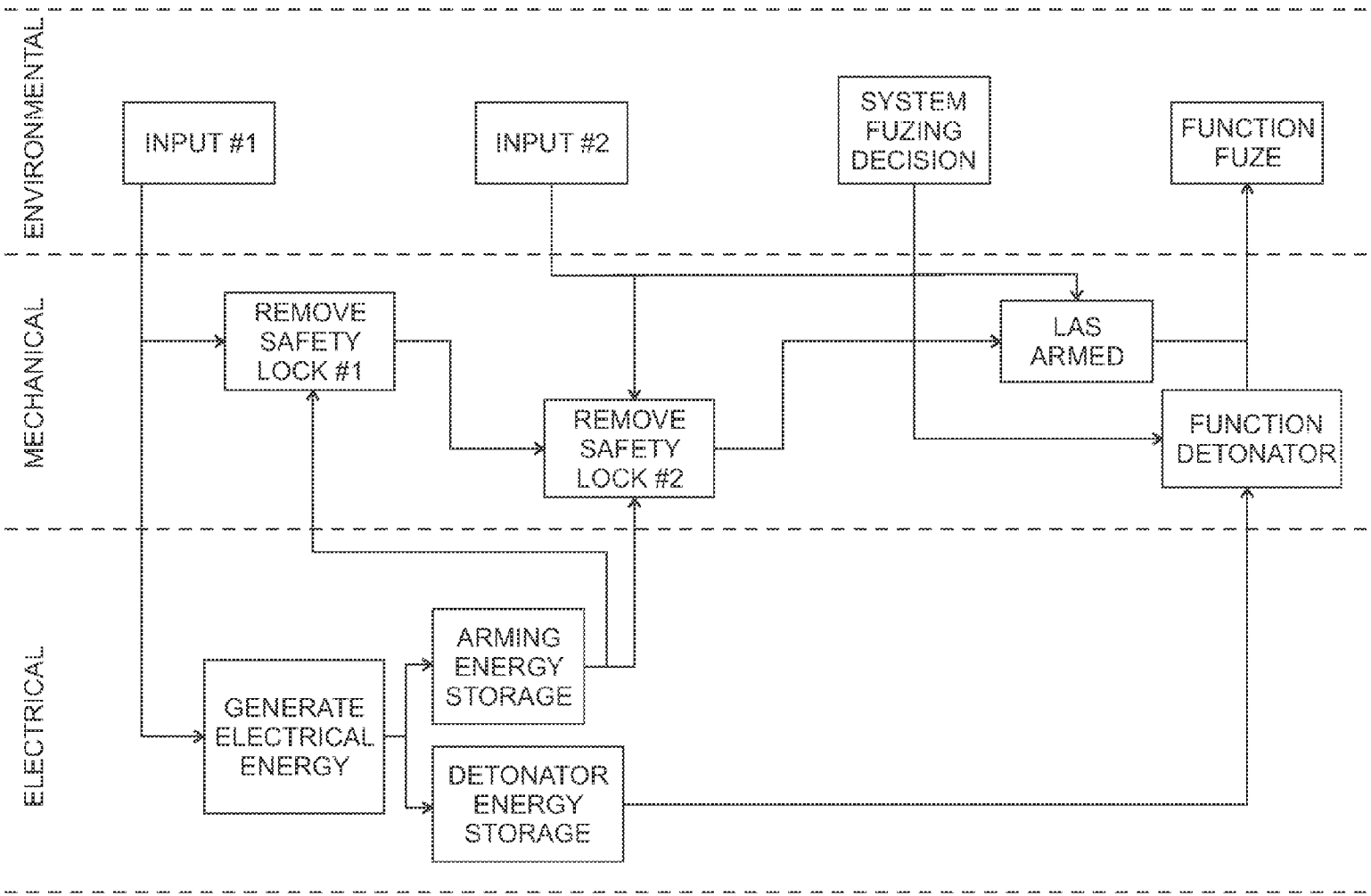
FIG. 8 is one example of a block-diagram description of the function of a fuze that may utilize the MEMS S&A device of FIG. 1.

FIG. 8 is one example of a block diagram description of the functions of a non-inertial fuze containing a non-inertial S&A assembly, such as assembly 12. The exemplary fuze may interact with its environment, arm itself, and then function. FIG. 8 illustrates the relationship between the external "environment" triggers and fuze operations (e.g., arming of slider 44 and functioning of the detonator (spot charge 86) after the system fuzing decision). In FIG. 8, "LAS" refers to latching and arming slider 44. FIG. 8 shows how interactions between the fuze and environmental forces affect the mechanical and electrical components of the fuze. The system fuzing decision may be, for example, a time-out, a target detection, receipt of an external signal, or other criteria. In some embodiments, the system fuzing decision may be an impact.

Methods of Making

A preferred method of constructing slider 44 is wafer-based lithography, plating and molding technology to achieve a magnetically permeable metal part, preferably nickel. Slider 44 may have nearly vertical side walls, smooth planar features on top and bottom faces, and tight in-plane dimensional tolerances on the order of ±5 microns. A suitable micro-fabrication technique to form such metal parts is LIGA (LIthographie, Galvanoformung, Abformung). An alternative, less expensive, method is to use lithographically based mold tools (LIGA tools) to press or form a number of additional molds made of, for example, plastic, and then plate the plastic molds with metal to form precision parts.

Frame 26 may be fabricated of metal and formed using similar lithographic-based plating and molding (LIGA) techniques. Alternative and more economic fabrication methods may include the use of multi-pass precision stamping; LIGA; precision mold tools used as part of micro-die-casting, micro-injection molding or molding; and sintering type technologies in structural materials such as steel, aluminum or tungsten. Fabricating frame 26 and slider 44 of the same material may reduce or eliminate changes to the working clearances due to differential thermal expansion and corrosion due to dissimilar metals.

Cover assembly 18 may be fabricated from a suitable non-brittle material that provides structural integrity and adequate explosive confinement for input explosive column 92 and gases generated by spot charges 88*a*, 88*b*, such as aluminum, steel, or structural plastic, or a combination thereof. Cover assembly 18 provides a planar ceiling or cover to allow motion of the moving parts of the MEMS S&A device 10, while constraining the moving parts in plane with frame 26. There is preferably a working clearance inside assembly 12 between cover assembly 18 and the top of slider 44, and between substrate 24 and the bottom of slider 44, to allow motion of slider 44. The preferred method of construction assures good working clearance (on the order of less than 100 microns) between slider 44 and features on frame 26, such as travel slot 28.

Output explosive assembly 20 may be fabricated in metal such as aluminum, steel, or zinc, or suitable alloys that provide adequate explosive confinement and compatibility for the output charge 98 as well as structural rigidity for the MEMS S&A assembly 12. If pins 22 are used to fasten assembly 12, they may be welded to output explosive assembly 20. Initiator board assembly 14 may be fabricated of typical multi-layer circuit board materials. Another method that may be used for integrating the components of assembly 12 may include stacking and sealing the various layers inside an enclosure, such as a metal "can."

Assembly 12 may be implemented at an arbitrary scale, for example, at a scale that is larger than the typical feature sizes for micro-scale, lithographic fabrication techniques such as LIGA. Such a device would have all the same function and features as assembly 12, except that working clearances might be significantly larger or different than the microns or tens-of-microns scale of MEMS fabrication. A larger scale device may be manufactured using "macro scale" or traditional technology to make the parts, such as machining, stamping, die casting, molding and sintering, etc. Another alternative fabrication method is the use of new technologies, for example multi-pass precision metal stamping or bulk metallic glass forming, that can achieve the same results and dimensional resolution as the preferred LIGA-based methods produce and also achieve the intended results of the invention, including mechanism function, firetrain implementation, fuze circuit interface, etc. For example, cover assembly 18 and output explosive assembly 20 may be fabricated using micro-mold and sinter or micro-die-casting type technologies.

FIGS. 2 and 3 show one embodiment of a non-inertial S&A assembly. However, assembly 12 is not the sole embodiment possible for proper device function. For example, two or more of the components of the S&A assembly 12, such as initiator board assembly, dielectric layer 16, cover assembly 18, MEMS device 10 and output explosive assembly 20 may be merged together if proper device function could be maintained. For example, MEMS S&A device 10 and output explosive assembly 20 could be combined into a single monolithic piece if so desired, with associated changes to explosive charges 78, 98. Additionally, the rectangular geometry of the components shown in the Figs. could be changed to any desired shape, as long as device functionality is maintained.

With regard to military hardware, assembly 12 may perform fuze safety and arming functions, improve fuze performance and reliability, expand the field of applications for fuzes with electronic fuze circuits and sensors, and miniaturize and reduce the cost of fuze functions for a large number of systems. Assembly 12 may be used with systems that, in the past, may not have had the option of safety and arming at all, or the option of safety and arming in full compliance with MILSTD 1316. In addition to military hardware, commercial and/or civilian applications may exist. Some military and civilian applications include hand grenade fuzes; cyborg insect and micro-robot payloads; unmanned vehicle systems; submunition grenades and mines; other military munition and explosive applications; emergency circuit breakers for high-voltage (power industry) applications; emergency escape hatches for reactors, tunnels, airframes, and ships; demolition and mining industry applications; aerospace applications such as on-orbit locking mechanism de-activation; and other non-military applications, such as within the commercial automotive industry (airbag safety; emergency lock-out prevention).

While the invention has been described with reference to certain preferred embodiments, numerous changes, alterations and modifications to the described embodiments are possible without departing from the spirit and scope of the invention as defined in the appended claims, and equivalents thereof. For example, a rotating arming disc or rotor may be used in place of the linearly translating slider 44, thereby utilizing rotational movement rather than translation. In such a rotary device, the mechanical logic and sequential locking and unlocking actions that pertain to the S&A functions may be implemented to control rotary motion rather than linear translation. A rotary type of device may include analogous designs for cantilevered arms, safety catch surfaces and deactivation cavities.

What is claimed is:

1. A safety and arming device, comprising:

a substrate;

a frame fixed to the substrate, the frame including a travel slot, a head socket, first and second gas expansion chambers having respective first and second nozzles, and first and second safety catch surfaces disposed adjacent to the respective first and second nozzles;

a slider translatably disposed in the travel slot in the frame, the slider including a latching head operable to latch in the head socket in an armed position of the device, a storage cavity for storing an explosive charge, first and second cantilevered arms disposed axially apart from each other and angled outwardly from the slider, and first and second deactivation cavities disposed adjacent to the respective first and second cantilevered arms; and a spring that biases the slider away from the head socket;

wherein, in a first safe position of the device, an end of the first cantilevered arm contacts the first safety catch surface to thereby prevent translation of the slider toward the head socket and an end of the second cantilevered arm is spaced apart from the second safety catch surface.

2. The device of claim 1, wherein the frame further comprises a second head socket, one end of the spring is fixed to the slider and another end of the spring is fixed to a second latching head, and the second latching head is disposed in the second head socket.

3. The device of claim 2, wherein the latching head and the second latching head include flexible barbs for locking the latching heads in respective head sockets.

4. The device of claim 1, wherein the substrate includes a receptor charge hole, the receptor charge hole being aligned with the storage cavity in the slider in an armed position of the device and not aligned with the storage cavity in the slider in the first safe position of the device.

5. The device of claim 4, wherein the receptor charge hole is a blind hole that opens on a side of the substrate opposite the frame.

6. The device of claim 4, further comprising a membrane disposed in the receptor charge hole between the substrate and the frame.

7. The device of claim 4, wherein in a second safe position of the device, the first cantilevered arm is plastically deformed into the first deactivation cavity and the end of the second cantilevered arm contacts the second safety catch surface.

8. The device of claim 7, wherein, in the second safe position of the device, the receptor charge hole is not aligned with the storage cavity in the slider.

9. The device of claim 8, wherein, in the armed position of the device, the first cantilevered arm is plastically deformed into the first deactivation cavity and the second cantilevered arm is plastically deformed into the second deactivation cavity.

10. A safety and arming assembly, comprising:

the safety and arming device of claim 4;

a cover assembly disposed adjacent to the safety and arming device, the cover assembly including an input explosive column and a pair of through holes for gas, one through hole communicating with the first gas expansion chamber and another through hole communicating with the second gas expansion chamber.

11. The assembly of claim 10, wherein, in an armed position of the safety and arming device, the input explosive column is aligned with the storage cavity in the slider and with the receptor charge hole in the substrate.

12. The assembly of claim 11, further comprising a dielectric layer disposed adjacent to the cover assembly, the dielectric layer including a first spot charge aligned with the input explosive column of the cover assembly, a second spot charge aligned with the one of the through holes in the cover assembly, and a third spot charge aligned with the other of the though holes in the cover assembly.

13. The assembly of claim 12, further comprising an initiator board assembly disposed adjacent to the dielectric layer, the initiator board assembly including electrically initiated circuits for initiating the first, second, and third spot charges in the dielectric layer.

14. The assembly of claim 13, further comprising an output explosive assembly disposed adjacent to the substrate of the safety and arming device, the output explosive assembly including an output explosive column aligned with the receptor charge hole in the substrate.

15. A method, comprising:

providing the device of claim 1;

delivering gas to the first gas expansion chamber;

using the gas to deform the first cantilevered arm into the first deactivation cavity;

exerting a force, other than an inertial force, on the slider to translate the slider toward the head socket;

contacting the second safety catch surface with the end of the second cantilevered arm to stop translation of the slider toward the head socket;

delivering a second gas to the second gas expansion chamber;

using the second gas to deform the second cantilevered arm into the second deactivation cavity; and translating the latching head of the slider into the head socket.

16. The method of claim 15, wherein the force is a magnetic force.

17. The method of claim 16, wherein exerting the force includes exerting the force continuously until the latching head is in the head socket.

* * * * *